United States Patent [19]

Noyori et al.

[11] Patent Number: 4,606,211

[45] Date of Patent: Aug. 19, 1986

[54] INDIRECT EXTRUSION PRESS

[75] Inventors: Tatsuhiko Noyori; Masakazu Ueda, both of Kobe, Japan

[73] Assignee: Kabushiki Kaisha Kobe Seiko Sho, Kobe, Japan

[21] Appl. No.: 703,616

[22] Filed: Feb. 21, 1985

[30] Foreign Application Priority Data

Feb. 25, 1984 [JP] Japan ..... 59-26174[U]

[51] Int. Cl.[4] ..... B21C 33/00

[52] U.S. Cl. ..... 72/270; 72/273.5

[58] Field of Search ..... 72/270, 273.5

[56] References Cited

U.S. PATENT DOCUMENTS

| | | | |
|---|---|---|---|
| 2,713,418 | 7/1955 | Kent | 72/270 |
| 3,616,672 | 11/1971 | Moos | 72/270 |
| 4,212,182 | 7/1980 | Steyvers | 72/273.5 |
| 4,230,661 | 10/1980 | Asari et al. | 72/273.5 |
| 4,314,471 | 2/1982 | Lukach | 72/270 |

FOREIGN PATENT DOCUMENTS

| | | | |
|---|---|---|---|
| 2843178 | 4/1979 | Fed. Rep. of Germany | 72/273.5 |

*Primary Examiner*—Lowell A. Larson

*Attorney, Agent, or Firm*—Oblon, Fisher, Spivak, McClelland & Maier

[57] ABSTRACT

An indirect extrusion press in which a seal block (16) is provided with a disc portion (18) to be fitted in a billet receiving bore (25) of a container (24) and is also provided with a cylindrical portion (19) contiguous to the disc portion (18) and having an outside diameter larger than the billet receiving bore (25) which is provided at the fore end of a pressure stem (15), and a die stem (21) is disposed in front of and coaxially with the pressure stem (15). Billet (V) is loaded onto an axis of the press by means of a billet loader (29), then charged into the billet receiving bore (25) of the container (24) from the pressure stem (15) side and then extruded through the die stem (21) in a state wherein one end of the billet receiving bore (25) of the container (24) is closed with the seal block (16). A plurality of circumferentially spaced notches (20) are formed in the press axis direction on the outer periphery of the cylindrical portion (19) of the seal block (16), both the container (24) and the billet loader (29) are movable toward the pressure stem (15), and a billet support portion (35) provided at the fore end of the billet loader (29) is formed with projections (39) adapted to engage the notches (20) and be guided thereby, the projections (39) being formed in the press axis direction.

4 Claims, 21 Drawing Figures

INDIRECT EXTRUSION PRESS

BACKGROUND OF THE INVENTION (1) Field of the Invention

The present invention relates to an indirect extrusion press and more particularly to an indirect extrusion press in which the charging of a billet into a container from a pressure stem side provided with a seal block at the fore end thereof can be done without dropping of the billet and without the need for lengthening the moving stroke of the container, by utilizing a retreat period of the container, to thereby shorten the press cycle time.

(2) Description of the Prior Art

In an indirect extrusion press having a seal block at the fore end of a pressure stem, one end of a container is closed with the seal block and in this state the container is fitted over a die stem whereby the billet is extruded through the die stem.

In such type of indirect extrusion presses, however, there arise problems particularly in connection with charging of a billet into the container.

For example, reference is here made to FIG. 1 illustrating a conventional press of this type, in which in charging a billet 4 which has been loaded onto the press axis through a billet loader 5, into a container 2 fitted on a die stem 3, the billet 4 is maintained at its maximum length or a billet pusher 6 is inserted into a pressure stem having a seal block 1 so as to extend through the seal block 1. In this conventional press, the billet 4 must be held in a gripped state between the seal block 1 and the die stem 3 or between the billet pusher 6 and the die stem 3 at the time of charging of the billet 4 into the container 2. In this state, however, the billet may drop because the billet loader 5 is in a retracted position.

Referring now to FIG. 2, there is illustrated another conventional example, in which one end of the container 2 is closed with the seal block 1, and the billet 4 which has been carried in by the billet loader 5 can be charged into the container 2 from the die stem 3 side. In this conventional extrusion press of FIG. 2, the problem of dropping of the billet 4 involved in the press of FIG. 1 can be overcome, but a spacing corresponding to the length of the billet 4 must be provided between the container 2 and the die stem 3, thus resulting in an increase of the overall press length. Besides, a billet charge stroke L2 and a container retreat stroke M2 can become long as compared with a billet charge stroke L1 and a container retreat retracting stroke M1 in the extrusion press of FIG. 1, thus resulting in the press cycle time becoming longer, which gives rise to a problem in terms of production efficiency.

SUMMARY OF THE INVENTION

With the foregoing situations in view, the present invention has as its object the provision of an indirect extrusion press having a seal block 1 at the fore end of a pressure stem as shown in FIG. 3, in which a billet 4 which has been loaded through a billet loader 5 can be charged into a container 2 fitted on a die stem 3, by utilizing retraction of the container, whereby dropping of billet is prevented during the same strokes as in the foregoing strokes L1 and M1.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

BRIEF DESCRIPTION OF THE DRAWINGS

FIGS. 4 to 12 illustrate an indirect extrusion press according to a first embodiment of the present invention, of which FIG. 4 is a sectional side elevational view of the press in an initial position; FIG. 5 is a sectional side elevational view of the press during billet charging; FIG. 6 is a sectional side elevational view of the press during extrusion; FIG. 7 is a sectional side elevational view of the press during discard ejection; FIG. 8 is a sectional side elevational view of the press during discard shearing; FIG. 9 is a front elevational view of the press during retraction of a billet loader; FIG. 10 is a front elevational view of the press during advance of the billet loader; FIG. 11 is a sectional view taken on line A—A of FIG. 10; and FIG. 12 is a view as seen in the arrowed direction B—B in FIG. 10;

FIGS. 13 to 16 illustrate a second embodiment of the present invention applied to a double action type indirect extrusion press using a billet of a solid structure, of which FIG. 13 is a sectional side elevational view of the press in an initial position; FIG. 14 is a sectional side elevational view of the press during billet charging; FIG. 15 is a sectional side elevational view of the press during piercing; and FIG. 16 is a sectional side elevational view of the press during extrusion;

FIGS. 17 to 20 illustrate a third embodiment of the present invention applied to a double action type indirect extrusion press using a billet of a hollow structure, of which FIG. 17 is a sectional side elevational view of the press in an initial position; FIG. 18 is a sectional side elevational view of the press during billet charging; FIG. 19 is a sectional side elevational view of the press during advance of a mandrel; and FIG. 20 is a sectional side elevational view of the press during extrusion.

DETAILED DESCRIPTION OF THE PREFERRED EMBODIMENTS

Figure 1:
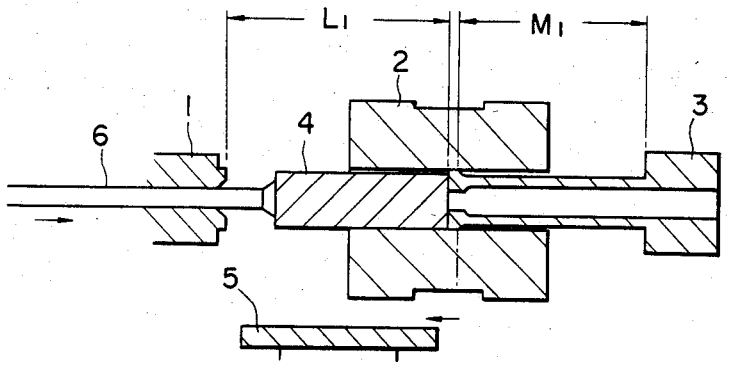
FIGURE 1 PRIOR ART
FIGS. 1 and 2 illustrate conventional indirect extrusion presses.
Figure 2:
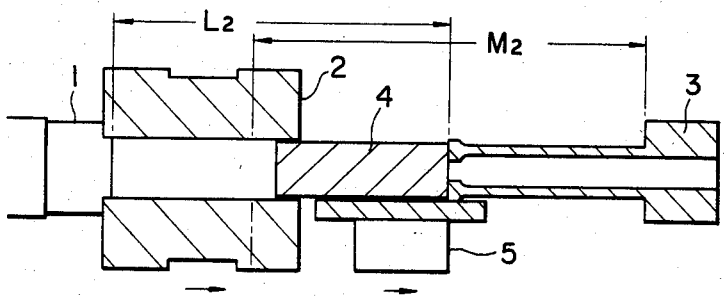
FIGURE 2 PRIOR ART
Figure 3:
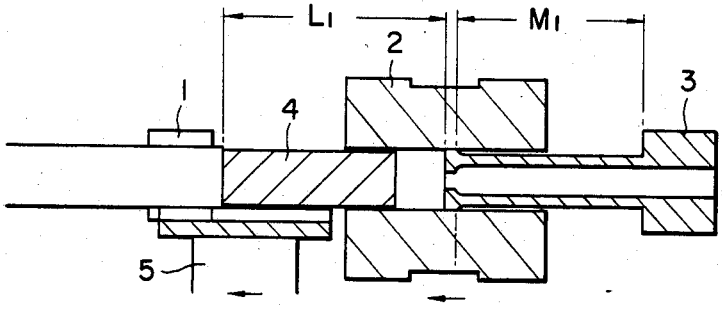
FIG. 3 is a schematic illustration of the present invention.

Embodiments of the present invention will now be described in detail with reference to the accompanying drawings.

In FIGS. 4 to 12, reference numeral 10 (see FIGS. 10–12) denotes a press bed on which are mounted a cylinder frame 11 and an opposite frame 12 face to face with each other. The cylinder frame 11 and the opposite frame 12 are rigidly connected through four columns 13 in this embodiment to constitute a press framework.

Numeral 14 denotes a main crosshead which can advance and retreat in the press axis direction through an extrusion force generator (not shown) using a hydraulic cylinder in the cylinder frame 11. A pressure stem 15 is attached to the front side of the main crosshead 14 on the press axis.

Figure 9:
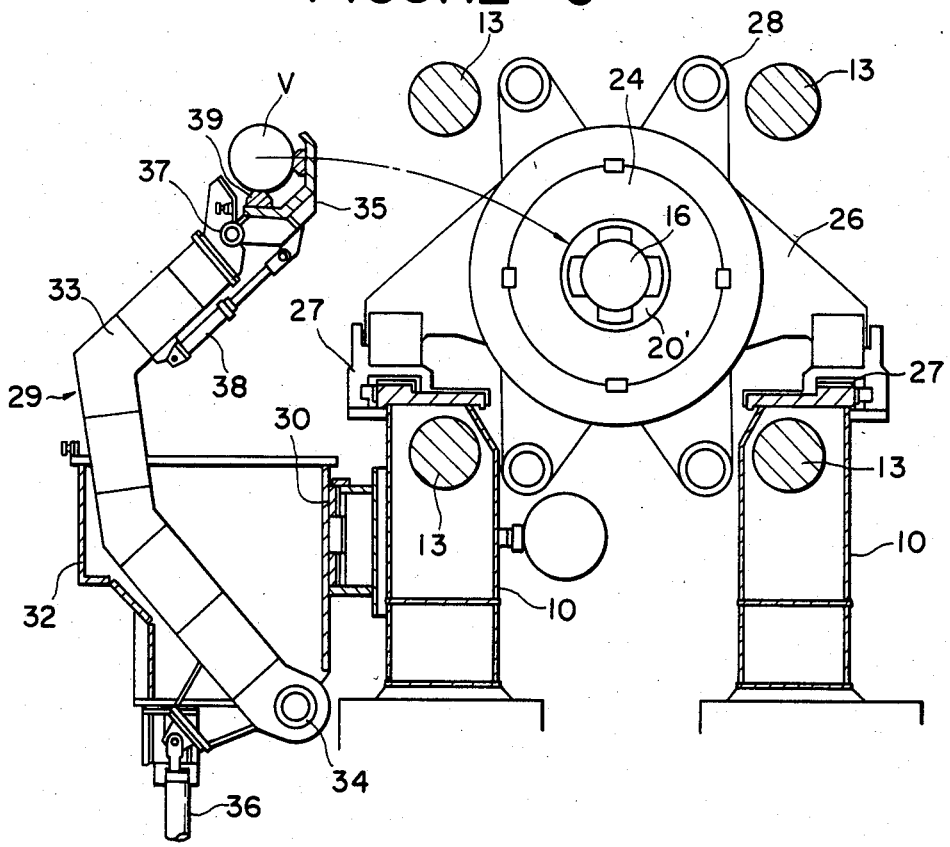
Figure 10:
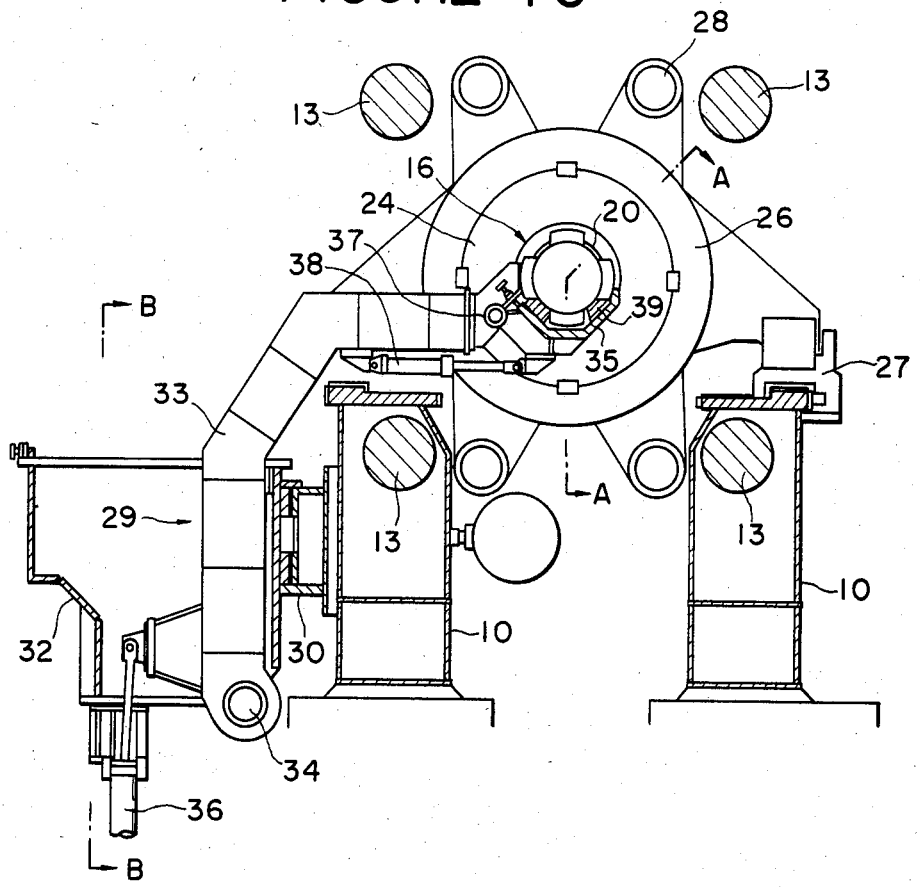
Figure 11:
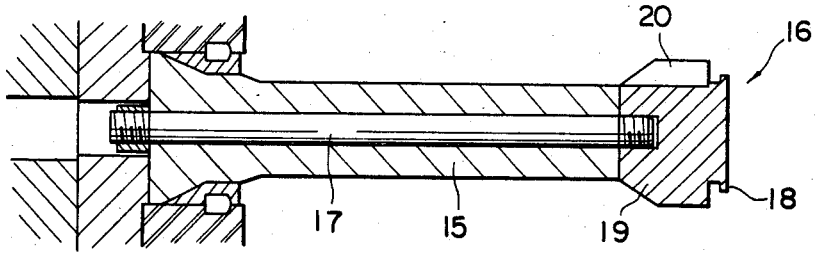

To the fore end of the pressure stem 15 is removably attached a seal block 16 through a long screw 17 as shown in FIG. 11 in this embodiment. The fore end of the seal block 16 is formed with a disc portion 18, and a cylindrical portion 19 is contiguous to the disc portion. On the outer periphery of the cylindrical portion 19 are formed a plurality of circumferentially spaced notches 20, four of which are disposed in a radial fashion as shown in FIGS. 9 and 10 in this embodiment and in the press axis direction as shown in FIG. 11.

Numeral 21 denotes a die stem of a cylindrical shape which is attached to the opposite frame 12 through a die stem holder 22. The die stem 21 is provided at an extension end thereof with a die 23 for defining an external form of an extruded product, and is coaxial with the pressure stem 15.

Numeral 24 denotes a container which is centrally provided with a billet receiving bore 25. The container 24 is supported on the press bed 10 side through a container holder 26 so as to be slidable in the press axis direction through a guide shoe mechanism 27. Container 24 is slidable by a container moving cylinder 28 of an expansion structure.

The disc portion 18 of the seal block 16 is disengageably fitted in one end of the billet receiving bore 25, and the front end face of the cylindrical portion 19 having an outside diameter larger than that of the disc portion 18 ovelaps with the end face of the container 24 to close the circumferential edge of the billet receiving bore 25.

Figure 12:
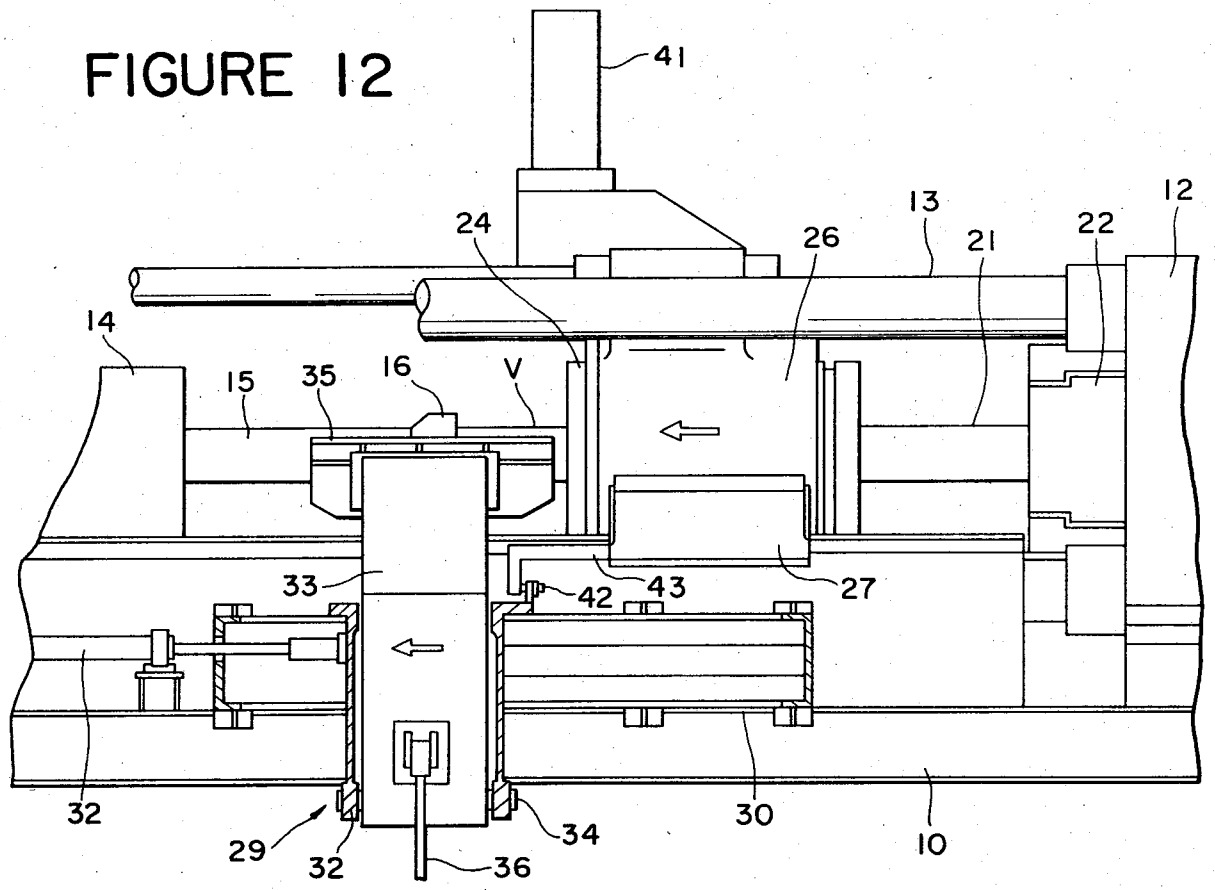

Numeral 29 denotes a billet loader. As shown in FIGS. 9, 10 and 12, the billet loader 29 is attached to a loader support 32 which is made slidable in the press axis direction by an expansion cylinder mechanism 31 through a guide shoe mechanism 30 as a vertical face portion on one side of the press bed 10. More specifically, a loader boom 33 is supported by the loader support 32 with its base end mounted on a horizontal shaft 34 so as to be pivotable in a transverse direction (orthogonal to the press axis) about the shaft 34. In addition, a billet support portion 35 provided at the fore end of the loader boom 33 is swingable through a swing cylinder mechanism 36 in this embodiment between a press axis position (FIG. 10) and a position deviating from the press axis.

In the billet support portion 35, a trough-like jaw is pivoted through a pin 37. The jaw can be moved pivotally by means of a jaw swing cylinder 38. On the supporting surface side of the support portion 35 are formed projections 39 in the press axis direction which projections are adapted to engage two of the notches 20 of the seal block 16 and are guided therealong.

In the drawings, moreover, numerals 40 and 41 appearing in FIGS. 4 to 8 denote a side cylinder mechanism and a shear mechanism, respectively, and numeral 42 in FIG. 12 denotes a stroke limiting bolt which is attached to the loader support 32 and which is engaged with the container 24 side through a bracket 43.

Figure 19:
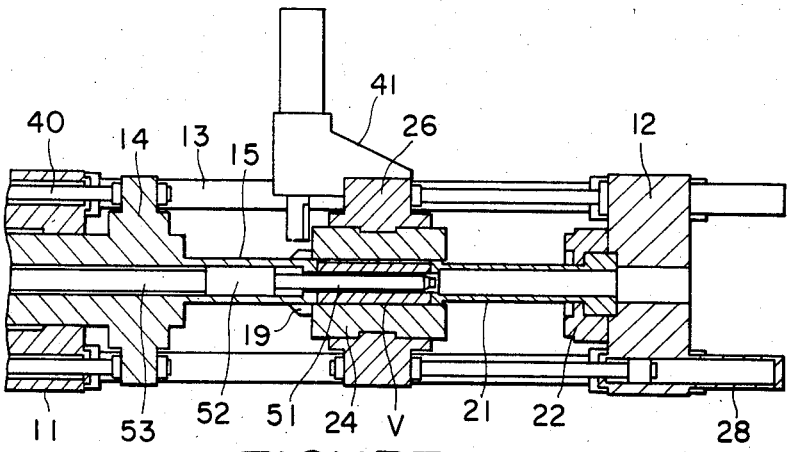
Figure 20:
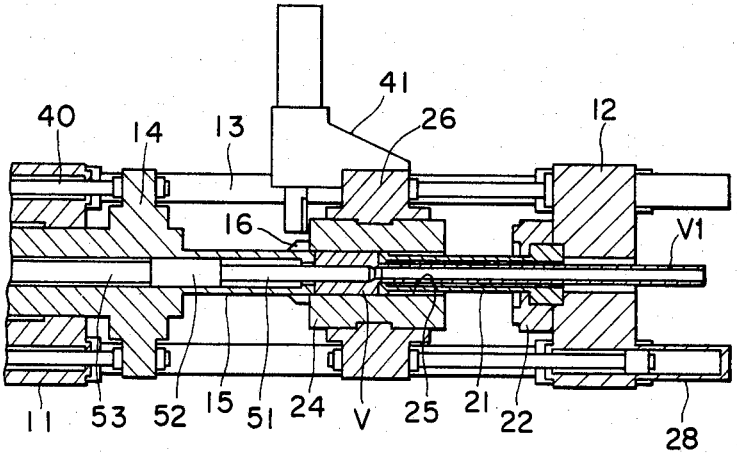
Figure 21:
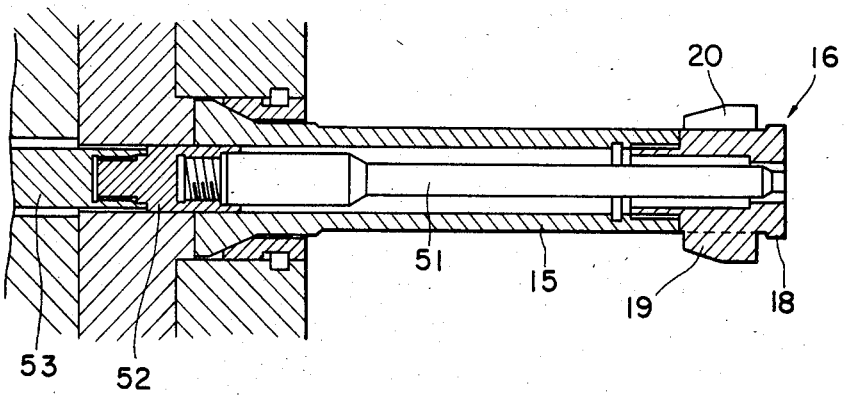
FIG. 21 is a sectional side elevational view of a pressure stem in a double action type.

FIGS. 13 to 21 illustrate embodiments of the present invention applied to a double action type indirect extrusion presses, of which FIGS. 13 to 16 show successive operation steps in which a billet (V) of a solid structure is used, and FIGS. 17 to 20 show successive operation steps in which a billet (V) of a hollow structure is used. In both embodiments there is used a cylindrical pressure stem 15 as shown in FIG. 21. Within the pressure stem 15, a mandrel 51 is attached to a mandrel holder 53 through a mandrel socket 52.

In these double action type indirect extrusion presses, a seal block 16 is threadedly secured to the pressure stem 15, and the mandrel 51 can be reciprocated by a mandrel cylinder device (not shown). Other basic constructional points are the same as in the first embodiment illustrated in FIGS. 4 to 12, so common members are indicated by common reference numerals.

The following description is now provided concerning the operation.

Figure 4:
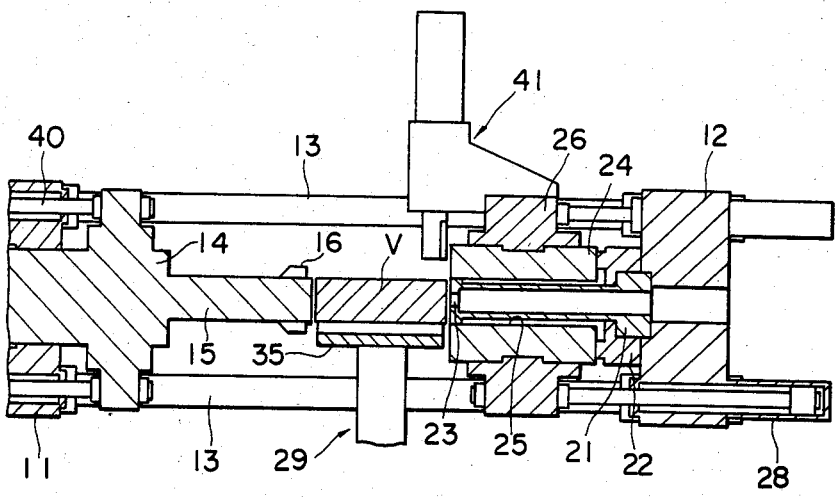
Figure 13:
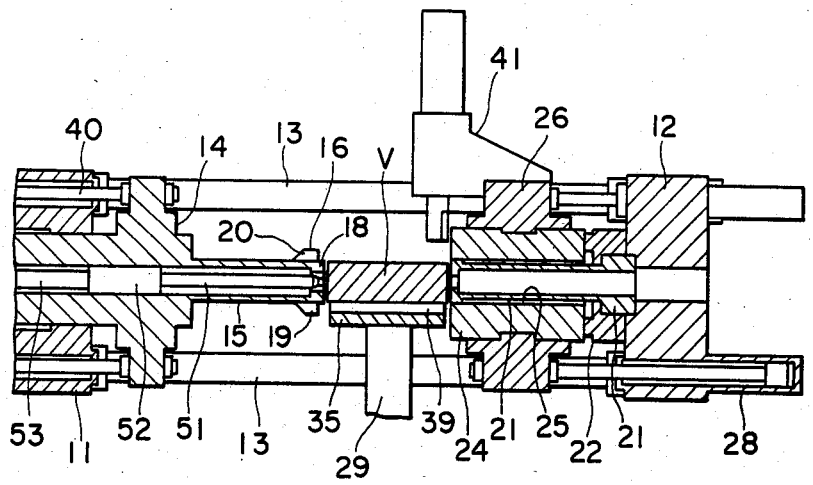
Figure 17:
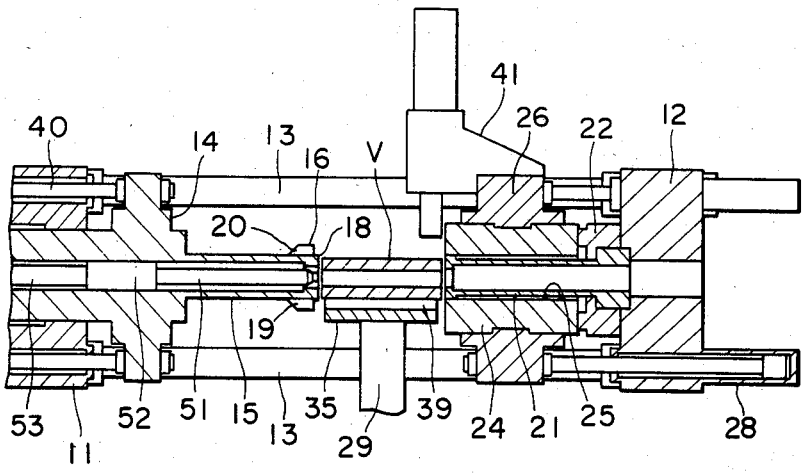

The extrusion presses shown in FIGS. 4, 13 and 17 are in the respective initial positions with the container 24 fitted on the die stem 21. The billet V is charged into the billet receiving bore 25 of the container 25 in the following manner.

The billet V is supported outside the press on the support portion 35 of the billet loader 29 as shown in FIG. 9. With extension of the swing cylinder mechanism 36, the loader boom 33 swings in the press axis direction about the horizontal shaft 34, whereby the billet is loaded onto the press axis at a position between the pressure stem 15 and the die stem 21. In this case, an adjustment is made through the jaw swing cylinder 38 so that the projections 39 of the billet support portion 35 are substantially axially aligned with the notches 20 of the seal block 16.

Figure 5:
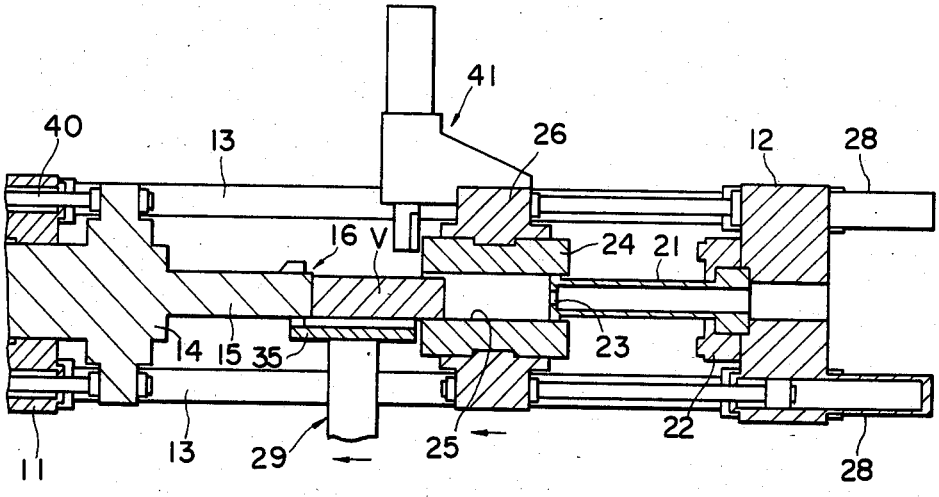

The billet V thus loaded onto the press axis between the pressure stem 15 and the die stem 21 through the billet loader 29 is charged into the container 24 from the pressure stem 15 side by moving both the billet loader 29 and the container 24 in the arrowed direction in FIG. 5 (leftward in the figure). Thus, the billet V is forced into the billet receiving bore 25 in connection with a relative motion through the seal block 16 provided at the fore end of the pressure stem 15. At this instant, interference between the cylindrical portion 19 of the seal block 16 and the projections 39 of the billet loader 29 is avoided because the notches 20 are formed in the cylindrical portion 19. The billet V can be charged into the container, without falling, in a positively supported state from below through the support portion 35 of the billet holder 29.

Figure 14:
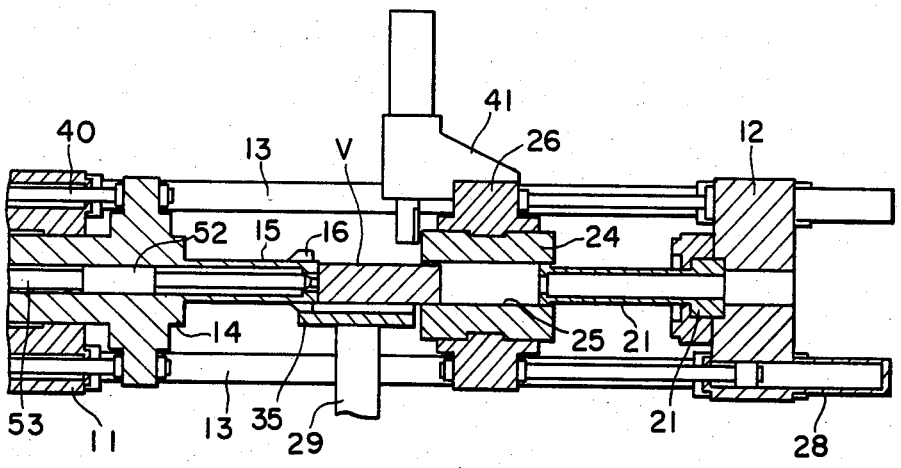
Figure 18:
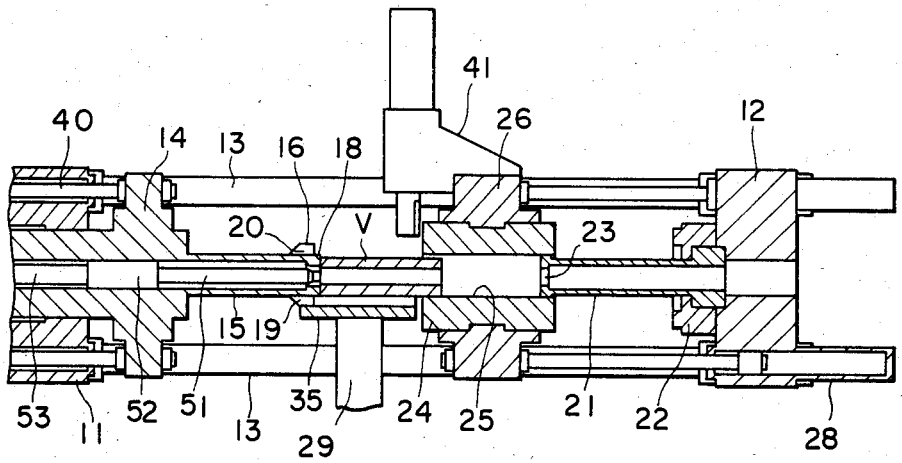

The above operations are the same also in the double action type indirect extrusion presses as shown in FIGS. 14 and 18.

After the billet V has thus been received in the container 24, the billet loader 29 is retracted to the exterior of the press. During this period, the pressure stem 15 is advanced until the disc portion 18 of the seal block 16 fits in the billet receiving bore 25 and the cylindrical portion 19 overlaps with the container end face to close the bore 25 of the container 24. In this state, the pressure stem 15 is advanced under no load to thereby allow the billet receiving bore 25 to be filled with the billet V.

Figure 15:
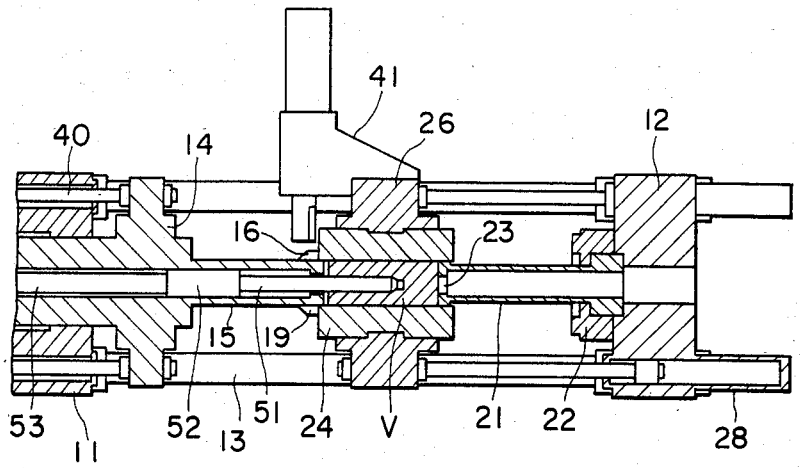

In the double action type indirect extrusion press using a billet V of a solid structure, the mandrel 51 is advanced so as to pierce the billet as shown in FIG. 15, and after completion of the piercing, a tip of the mandrel 51 is stopped and fixed in a position where it faces the die hole of the die stem 21 whereby a space for an extruded tube is defined.

In the double action type indirect extrusion press using a billet V of a hollow structure, the mandrel 51 is advanced in a skewered form with respect to the billet V as shown in FIG. 19, and the mandrel tip is stopped and fixed in a position where it faces the die hole of the die stem 21.

Figure 6:
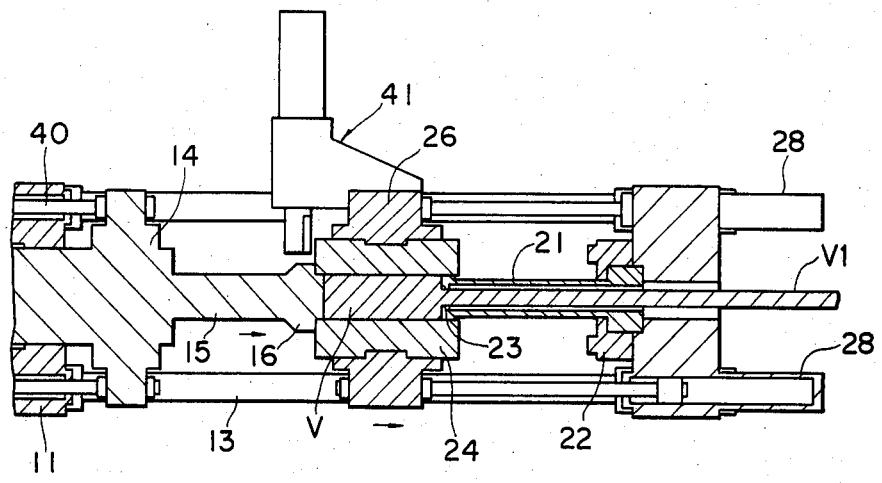
Figure 16:
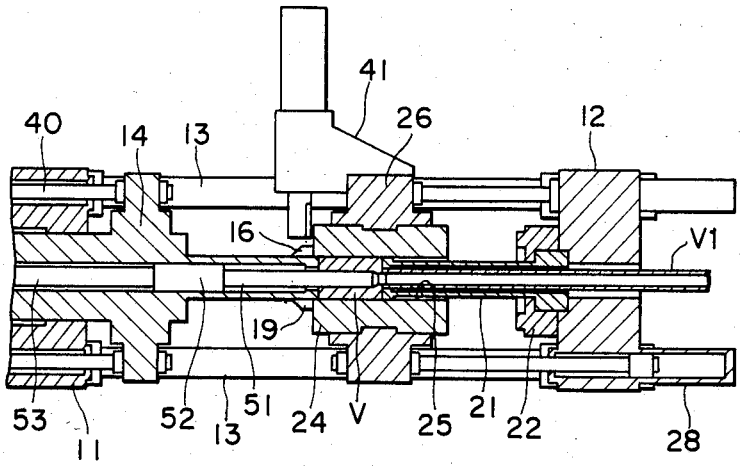

Then, an extrusion force is imparted to the pressure stem 15 by the extrusion force generator, whereby the billet V is extruded in an extruded form V1 indirectly through the die 23 of the die stem 21 in the absence of dynamic friction between the container 24 and the billet V as shown in each of FIGS. 6, 16 and 20.

Figure 7:
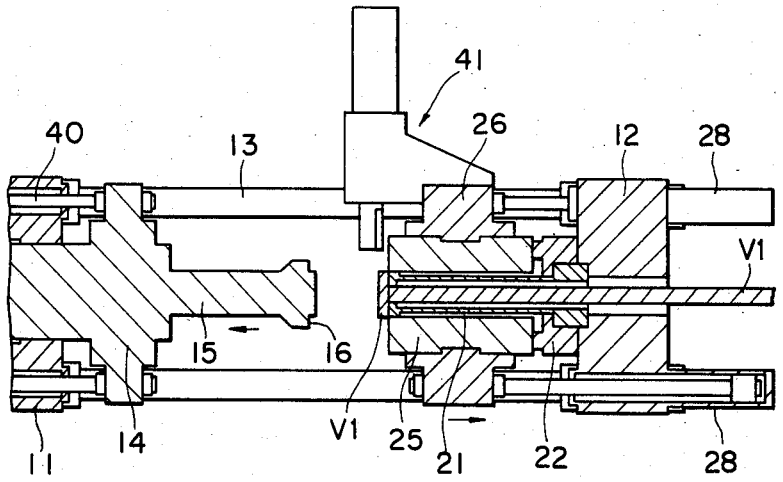
Figure 8:
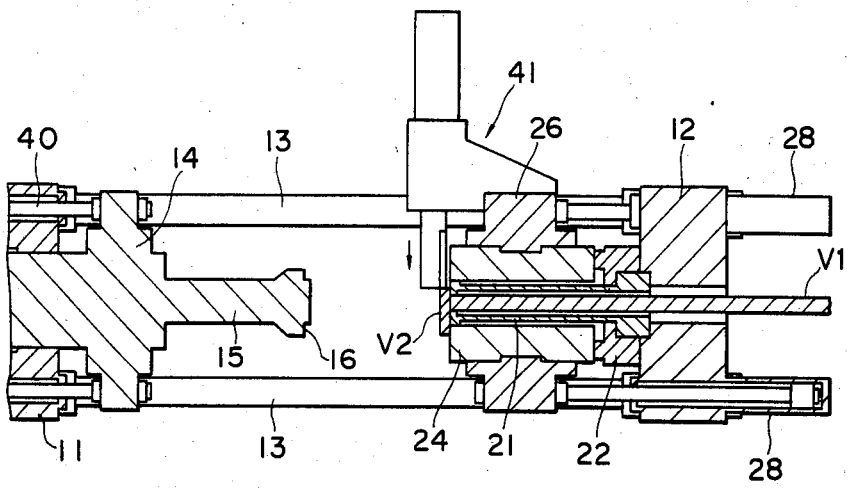

After completion of the extrusion, the pressure stem 15 is retracted and the container 24 is advanced to thereby project a discard member V2 from the container 24 as shown in FIG. 7, and then the discard member V2 is cut from the extruded form V1 as shown in FIG. 8. The press cycle is now completed. During such shearing period, the billet loader 29 is returned to its load stand-by position.

Although in the above embodiments the billet loader 29 is a swing type loader, such may instead be a lift type loader using a lift cylinder.

In short, according to the present invention there is provided an indirect extrusion press in which a seal block (16) having a disc portion (18) to be fitted in a billet receiving bore (25) of a container (24) and a cylindrical portion (19) contiguous to the disc portion (18) and having an outside diameter larger than the billet receiving bore (25) is provided at the fore end of a pressure stem (15), and a die stem (21) is provided in front of and coaxially with the pressure stem (15), and a billet V is loaded onto an axis of the press through a billet loader (29), then charged into the billet receiving bore (25) of the container (24) from the pressure stem (15) side and then extruded through the die stem (21) in a state in which one end of the billet receiving bore (25) of the container (24) is closed with the seal block (16), characterized in that a plurality of circumferentially spaced notches (20) are formed in the press axis direction on the outer periphery of the cylindrical portion (19) of the seal block (16), that the container (24) and the billet loader (29) are both movable toward the pressure stem (15) and that a billet support portion (35) provided at the fore end of the billet loader (29) is formed with projections (39) adapted to engage the notches (20) and be guided thereby, the projections (39) being formed in the press axis direction.

Such indirect extrusion press of the present invention brings about the following advantages.

In charging the billet V into the container 24, since the cylindrical portion 19 of the seal block 16 is formed with the axial notches 20 and the support portion 35 of the billet loader 29 is formed with the projections 39 adapted to engage the notches 20 and thereby be guided, there will be no interference between the loader 29 and the seal block 16 even when the loader 29 and the container 24 are moved together, and the billet V can be positively charged in a supported state from below without the need for lengthening the moving strokes of the pressure stem 15 and the container 24, thus permitting shortening of the cycle time. Thus, the present invention is very advantageous in its application to extrusion presses of an indirect type and a combined direct and indirect type.

Obviously, numerous modifications and variations of the present invention are possible in light of the above teachings. It is therefore to be understood that within the scope of the appended claims, the invention may be practiced otherwise than as specifically described herein.

What is claimed is:

1. An indirect extrusion press assembly, comprising:

a container having a billet receiving bore;

a pressure stem;

a seal block having a disc portion to be fitted in said billet receiving bore of said container and having a cylindrical portion contiguous to the disc portion and an outside diameter larger than said billet receiving bore;

a die stem disposed in front of and coaxial with said pressure stem;

means for loading a billet onto an axis of the press and charging said billet into said billet receiving bore of the container from a pressure stem side and then extruding said billet through said die stem in a state in which one end of the billet receiving bore of the container is closed with the seal block, wherein a plurality of circumferentially spaced notches are formed in a press axis direction on an outer periphery of the cylindrical portion of the seal block;

means for moving said container and said billet loader toward said pressure stem; and a billet support portion mounted to a fore end of the billet loader and which includes a plurality of projections adapted to engage said notches of said cylindrical portion of said seal block and be guided thereby, said projections being formed in a press axis direction.

2. An indirect extrusion press according to claim 1, wherein said billet loader further comprises a swing type billet loader and further comprising a swing cylinder for actuating said swing type billet loader.

3. An indirect extrusion press according to claim 1, wherein the billet loader further comprises a lift type billet loader and further comprising a lift cylinder for actuating said lift type billet loader.

4. An indirect extrusion press according to claim 1, further comprising a mandrel holder, a mandrel socket and a mandrel wherein said pressure stem further comprises a cylindrical pressure stem within which said mandrel is attached to said mandrel holder via said mandrel socket.

* * * * *